US006158256A

United States Patent [19]

Kurschatke et al.

[11] Patent Number: 6,158,256

[45] Date of Patent: Dec. 12, 2000

[54] DEVICE FOR LIQUID TREATMENT OF TEXTILE WEB

[75] Inventors: Wolfgang Kurschatke; Stefan Krebs, both of Krefeld, Germany; Drahomir Dvorsky, Dvur Karlove N.L, Czech Rep.

[73] Assignee: Eduard Kusters Maschinenfabrik GmbH & Co. KG, Krefeld, Germany

[21] Appl. No.: 09/171,834

[22] PCT Filed: Jan. 10, 1997

[86] PCT No.: PCT/DE97/00032

§ 371 Date: Aug. 18, 1999

§ 102(e) Date: Aug. 18, 1999

[87] PCT Pub. No.: WO97/41289

PCT Pub. Date: Nov. 6, 1997

[30] Foreign Application Priority Data

Apr. 27, 1996 [DE] Germany ..... 296 07 591 U

[51] Int. Cl.[7] ..... D06B 3/18; D06B 3/32

[52] U.S. Cl. ..... 68/22 R; 68/175; 68/180

[58] Field of Search ..... 68/22 R, 175, 68/180

[56] References Cited

FOREIGN PATENT DOCUMENTS

| | | | |
|---|---|---|---|
| 675879 | 5/1939 | Germany | 68/180 |
| 36 12 999 | 11/1986 | Germany . | |
| 471 926 | 4/1969 | Switzerland . | |

*Primary Examiner*—Philip R. Coe
*Attorney, Agent, or Firm*—Kenyon & Kenyon

[57] ABSTRACT

An apparatus for liquid treatment of a textile web having at least one driven winding roller, onto which the textile web can be wound, and a basin located below the winding roller and extending over its length, which can be filled with treatment liquid, in which at least one deflection roller for the textile web is arranged. A guide roller which extends parallel to the axis of the winding roller over the width of the textile web, and rests against the fabric roll which forms on the winding roller, from the bottom, is provided, and has openings on its otherwise cylindrical circumference, which are arranged so as to avoid zones without openings which run in the circumference direction, and are uniformly distributed over the circumference.

14 Claims, 2 Drawing Sheets

DEVICE FOR LIQUID TREATMENT OF TEXTILE WEB

BACKGROUND OF THE INVENTION

The invention relates to a device for providing a liquid treatment to a textile web. Typically, such a device will have at least one driven one driven winding roller onto which the textile web can be wound. A basin is provided below the winding roller in each instance and extends over the length of the machine; it can be filled with treatment liquid. Such machines also typically have at least one deflection roller for the textile web and a guide roller which extends parallel to the axis of the winding roller over the width of the textile web, and which rests against the fabric roll which forms on the winding roller, from below. The textile web is guided into the basin from below around the deflection roller up to the guide roller, and through the nip between the guide roller and the fabric roll, onto the fabric roll.

Such devices or parts of devices primarily occur in jiggers which include two winding rollers, arranged next to one another in a housing, at equal height, parallel to one another, and reversibly driven, between which the textile web can be wound back and forth. Under the winding rollers, a container arrangement is provided, through which the web is passed when it is wound from one winding roller to the other, before it is wound onto the winding roller which is winding the web up at that time. The basin of the basin arrangement assigned to the winding roller which is winding up the web, and this winding roller itself, form the device with which the invention is concerned.

A jigger in which the device according to the preamble is implemented is evident from DE 36 12 999 C2.

In recent times, because of fashion developments, there has been a particularly great demand for thin, almost translucent fabrics made of acetate or viscose, which are to be dyed a uniform color on a jigger. In this connection, fabric finishers are making ever greater demands with regard to the working speed and the volume capacity of the individual rollers.

It has been shown that textile webs of the type in question can be processed without problems, up to a length of approximately 1000 m, on conventional jiggers with winding rollers with a diameter of approximately 300 mm. However, if lengths on the order of 3000 to 5000 m are to be wound onto a roller, there are difficulties in the uniformity of the dye color. A fabric finisher demands that the guide roller does not rest against the fabric roll which forms on the winding roller which is winding up the web, because otherwise the web will be squeezed, when using the usual closed guide rollers, and significant portions of the dye liquid entrained from the container by the web will be removed. Since the fabrics in question, such as acetate or viscose, are not particularly receptive to the dye, a large number of passages on the jigger is required in order to bring about the necessary uniformity of dye color. Not enough dye liquid is "wound in." On the other hand, in order for perfect formation of the fabric roll, particularly in the case of thin webs which lie on top of one another in many layers, it is absolutely necessary to exert an influence on the cylindricity of the fabric roll by resting the guide roller against it, thereby giving it a certain hardness, because otherwise the fabric roll is too unstable. These two requirements run counter to one another.

SUMMARY OF THE INVENTION

This invention is directed to the object of providing a device of the general type set forth above such that it is possible to wind up multi-layer fabric rolls or rollers, as described, without too much of the treatment fluid which has been applied being removed from the textile web. The solution presented herein entails using guide rollers having isolated openings on its otherwise cylindrical circumference, which are surrounded all around by the cylindrical circumference of the guide roller which are arranged so as to avoid zones without openings which run in the circumference direction. These openings are uniformly distributed over the circumference of the guide rollers.

In the known art, the guide rollers which rest against the fabric roll on the winding roller which is winding up the textile web are made of closed cylindrical rollers. These form a type of roller nip with the fabric roll, in which part of the treatment liquid entrained by the web is squeezed off from the web, so that a bead of liquid forms in front of the nip, with the contents of this bead being removed from the web.

In the invention, on the other hand, escape possibilities are offered to the liquid entrained by the textile web. A bead no longer forms in front of the gap, rather the liquid enters into the openings, as the textile web, which is under a certain tension, starts to pass around the guide roller, and this liquid is absorbed again, at least to a large part, when the textile web leaves the nip, so that the squeeze-off effect is eliminated or at least is present only to a significantly reduced extent. Because of the otherwise cylindrical shape of the circumference of the guide roller, however, it can still exert its winding function, so that cylindrical fabric rolls with the necessary strength are formed.

From CH 471926A, a jigger is known with guide rollers which rest against the fabric rolls and have screw-like circumference grooves, which are supposed to facilitate drainage of the liquid from the roller nip between the guide roller and the fabric roll. This is in contrast to the invention, in which the liquid is specifically intended to be temporarily held in place.

The openings can be structured as depressions in the circumference of the guide roller, i.e. they can have a closed bottom.

However, an alternative possibility is that the openings are structured as perforations in the guide roller mantle, which pass into the interior of the guide roller.

In this connection, part of the treatment liquid taken up by the openings therefore passes into the interior of the guide roller. However, because of the short looping path and the high working speed which is aimed at, enough treatment liquid remains in the region of the openings, even if they do not have an actual "bottom," so that when the textile web leaves the nip, it can get back a sufficient amount of treatment liquid.

In a first preferred embodiment, the openings are formed by isolated perforations, surrounded all around by the cylindrical circumference of the guide roller.

It is practical that these individual perforations, be arranged on axis-parallel mantle lines and, in the case of adjacent mantle lines, be offset axially, relative to one another, in order to produce uniform coverage of the web width with perforations, and to prevent the occurrence of strip-shaped zones where different treatment with treatment liquid takes place.

It is practical that such perforations be structured as axis-parallel oblong perforations.

When perforations, i.e., breaks in the guide roller tube, are involved, the latter can be made of perforated sheet metal or lattice material, with the breaks in this material forming the openings.

If the guide roller has a long length, in accordance with the textile web width, of 4 m or 5 m, for example, it is recommended to provide a continuous, stable tube axis and to support the guide roller tube made of the perforated material from the inside, by disks distributed over the length of the axis and resting on it.

In an alternative embodiment, the guide roller comprises a closed, cylindrical inner roller, on which a perforated sheet metal or lattice material which covers its entire circumference and rests directly on it is attached. This results in "depressions" at the openings, where the inside tube represents the "bottom of the depressions." In contrast to isolated perforations, the openings can also be structured as grooves or channels which extend over at least a significant part of the circumference surface, so that they can demonstrate a very length-preferred expanse.

Depending on the type of treatment liquid and particularly on the type of fabric to be processed, the open total area of the openings in the circumference of the guide roller amounts to 10 to 50% of the circumference surface of the latter.

BRIEF DESCRIPTION OF THE FIGURES

The drawings illustrate several embodiments of the invention.

DETAILED DESCRIPTION

Figure 1:
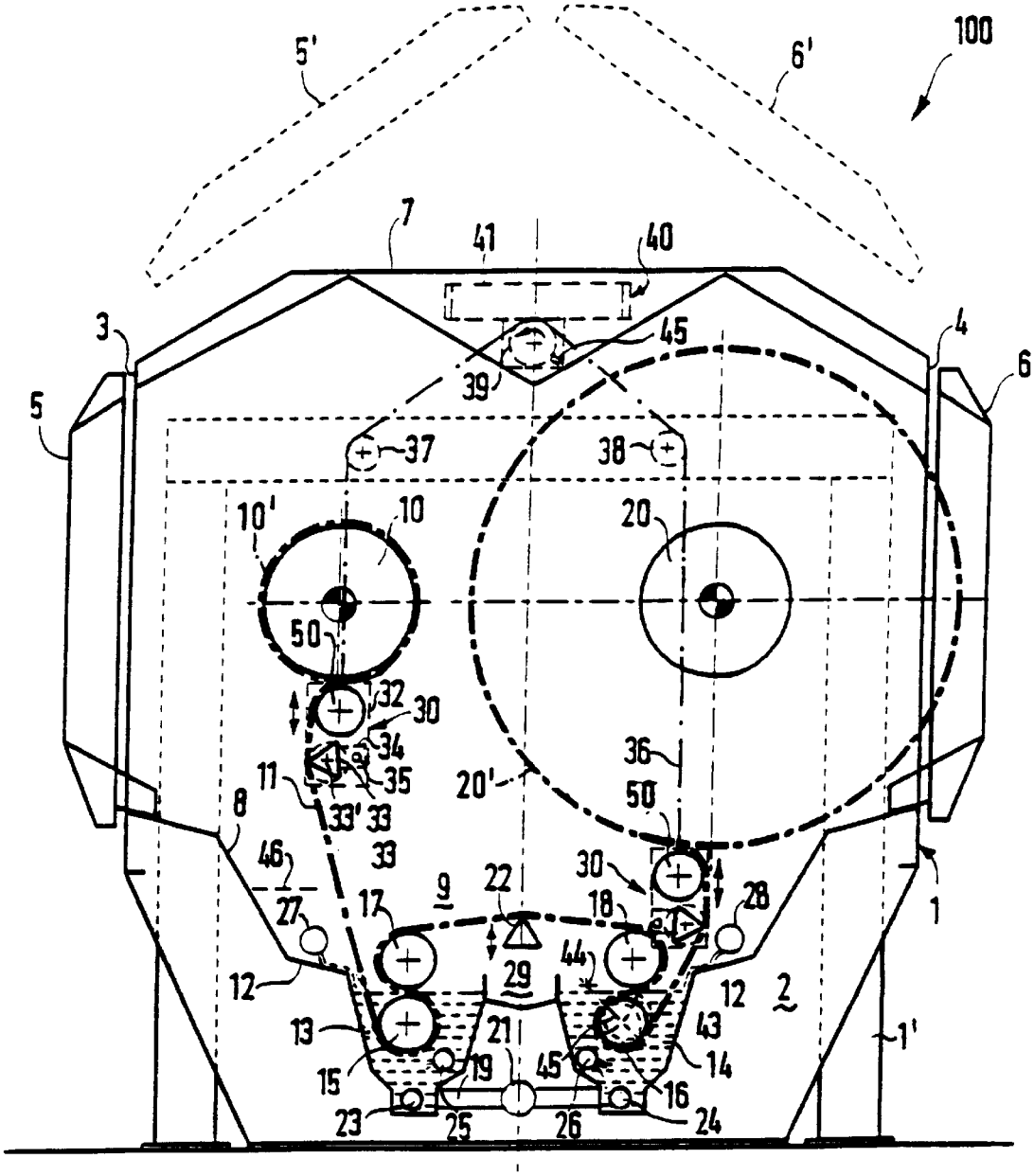
FIG. 1 is a schematic front view of a jigger which forms the exemplary embodiment of the invention.

The jigger, designated as a whole as 100 in FIG. 1, comprises a housing 1 which is held by a frame 1' made of steel profile beams. Housing 1 possess vertical back and front walls 2 located behind and in front of the plane of the drawing, respectively, parallel to one another, as well as vertical side walls 3, 4, which connect the former, and have openings which can be closed off by trough-shaped lids 5, 6, which can be brought into positions 5', 6' above top 7 of jigger housing 1, as indicated with broken lines, on connecting rods, not shown, in order to make it possible to put rolls into place or remove them, or to clean jigger 100.

In its lower region, housing 1 has a bottom which covers the entire footprint, forming a low liquid trough 9. Above bottom 8, approximately half way between it and top 7 of housing 1, driven winding rollers 10, 20 are mounted in housing 1, in the same horizontal plane and parallel to one another. In the work phase being shown, textile web 1 is being wound off winding roller 20 and wound onto winding roller 10, forming a fabric roll. Fabric roll 20' on winding roller 20 comprises almost the entire length of fabric, and has a diameter of 130 cm, for example. In order to be able to keep housing 1 narrow between side walls 3, 4, fabric roll 20' also projects slightly into trough-shaped lid 6.

From bottom 12 of the part of bottom 8 which forms liquid trough 9, two relatively narrow containers 13, 14, parallel to one another, extend down to winding rollers 10, 20; they have as small a cross-section as possible and therefore as small a volume capacity as possible. Only one deflection roller 15, 16, for example with a diameter of 120 mm, is housed in each of containers 13, 14, arranged at the same height in the footprint region between winding rollers 10, 20. Textile web 11, coming from winding roller 20, is guided from the top around the bottom part of deflection roller 16 of right container 14, and thereby saturated with the liquid standing in container 14. A deflection roller 18 arranged at a distance above deflection roller 16, above the liquid surface, ensures that the fabric loops around deflection roller 16 by more than 180°. Textile web 11 is then guided from the top of deflection roller 18, essentially horizontally, via a deflection roller 17 arranged at a distance above deflection roller 15 in left container 13, and from there down, around deflection roller 15, by more than 180°, and from the left side of the latter, in accordance with FIG. 1, up to fabric roll 10' on winding roller 10.

Containers 13, 14 can be connected with one another via a connecting pipe 19 with a valve 21. Separately controlled heating systems in the form of heating pipes 23, 24, for indirect heating of the treatment liquid located in basins 13, 14 (electrical heating rods or heating rods with oil flowing through them) and in the form of steam jet pipes 25, 26 for direct heating of the treatment liquid, can be provided in containers 13, 14.

The walls of basins 13, 14 are built as closely around deflection rollers 15, 16 as practically possible, in order to keep the liquid volume small.

Fresh treatment liquid is fed in via feed pipes 27, 28, with the filling level in basins 13, 14 being constantly monitored.

When textile web 11 changes over from basin 14 into basin 13 (or vice versa), it passes through a stripping pipe 22, triangular in cross-section, which can be adjusted in height in the direction of the arrow, and brought out of contact with the textile web by being lowered. Stripping pipe 22 strips liquid from the bottom of textile web 11, from where it is conducted away, in order to be disposed of or returned to the process.

Under both winding rollers 10, 20, guide roller/spreader combinations 30 can be moved up and down on vertical guides, not shown, in the direction of the arrows. Combinations 30 each comprise a guide roller 50 which is mounted to rotate in the upper region, i.e. the region adjacent to winding rollers 10 or 20, on end plates 32 provided on both side of the textile web, interacting with the vertical guide.

Below guide roller 50, between end plates 32, a triangular stripping pipe 33 is mounted to pivot around an axis which runs parallel to its own axis, and has end pieces 34 at its ends, running in the crosswise direction, which are connected with one another by an adjustable tension anchor 35, outside of the cross-section of stripping pipe 33, which anchor ensures a greater or lesser deflection or forward arching of stripping pipe 33 against textile web 11, depending on the tension exerted. Depending on the pivot position, stripping pipe 33 can be brought into engagement at the front or back of textile web 11, or moved entirely out of the path of textile web 11. Pivoting takes place around an axis 33' located in the region of the cross-section of stripping pipe 33. The two guide roller/spreader combinations 30, each on one side of textile web 11, are each suspended on a chain 36 which forms a flexible tension element, which chain is guided via deflection disks 37, 38 mounted above winding rollers 10, 20, and passes over a drive disk 39 in the form of a chain sprocket wheel, located in between and higher, which sprocket wheel is arranged on the drive shaft of a rotary drive 40, which is formed by a hydraulic or pneumatic cylinder 41 with a pinion gear which engages from the side.

In the work phase shown, in which the fabric is being wound onto winding roller 10, rotary drive 40 exerts a pre-determined torque in the direction of the arrow, so that the left guide roller/spreader combination 30 is drawn against the circumference of fabric roll 10' from below. In this connection, guide roller 50 rests directly against the outside circumference of fabric roll 10'.

Guide roller/spreader combination 30 assigned to winding roller 10, 20 in each instance faithfully follows the changing diameter of the fabric roll being wound up in each instance. The location of guide roller/spreader combination 30 is translated by chain 36 into a rotation of chain sprocket 39, which is rotation-connected with a rotation transmitter 42, which gives off digital signals corresponding to the angle of rotation, obtained, for example, photoelectrically or in similar manner. These signals can be used to control the drive motor of the winding roller which is winding up the fabric, winding roller 10 in the example shown. Control takes place in such a way that textile web 11 is wound up at a uniform speed. In other words, the speed of rotation of winding roller 10 must be lowered, in accordance with the increasing diameter of the fabric roll.

In order for a uniform textile web tension to be maintained, also, during the winding process, the drive motor of the winding roller which is unwinding the fabric, winding roller 20 in the exemplary embodiment shown, must follow with a certain braking torque. In order to accomplish this, deflection roller 16 which dips into basin 14 is part of a compensator 43, only shown schematically, i.e. it is mounted on connecting rods 45 which are mounted to pivot at bearing locations 44. If the drive motor of winding roller 20 runs too slowly, deflection roller 10 moves up into the position shown with a dot-dash line, as connecting rods 45 pivot, which causes signals to be issued to the drive control, causing the latter to appropriately accelerate the drive motor of winding roller 20. This holds true analogously if the drive motor of winding roller 20 is running too fast.

Depending on the mode of operation and the contents of basins 13, 14, jigger 100 can be used to carry out all kinds of treatments, and only small amounts of treatment liquid have to be disposed of when the treatment liquid is changed, because of the small volume of basins 13, 14.

It is understood that guide roller 50 on the right in FIG. 1, assigned to winding roller 20, is structured in the same manner as left guide roller 50, and that when the fabric is wound onto right winding roller 20, it is pressed against fabric roll 20' which forms there, from below, at a predetermined force.

Figure 2:
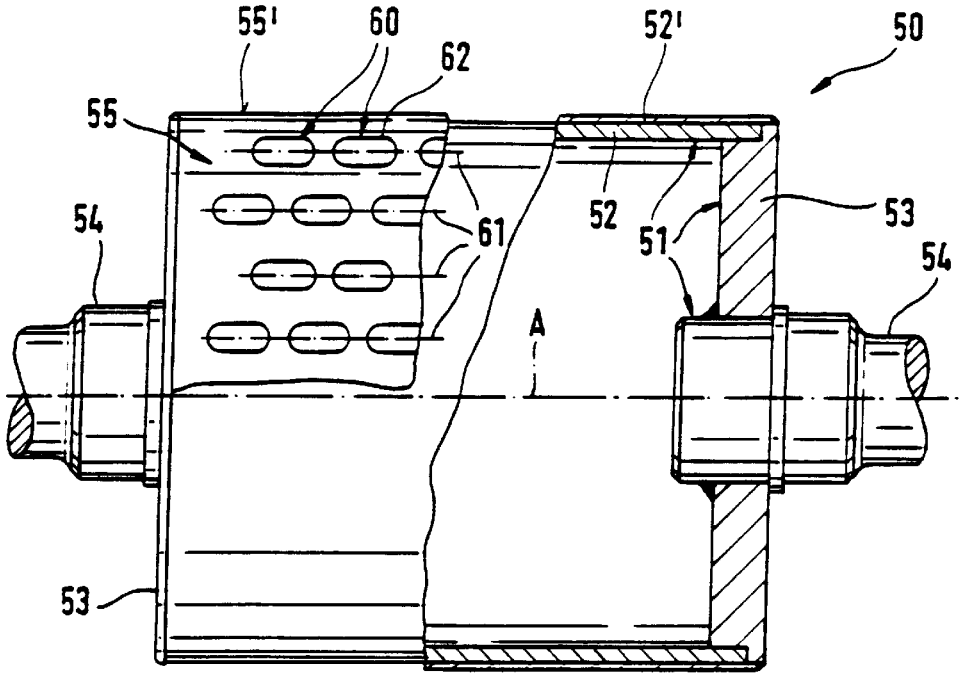
FIGS. 2 and 3 provide views, partly in cross-section, of two possible embodiments of the guide roller.
Figure 3:
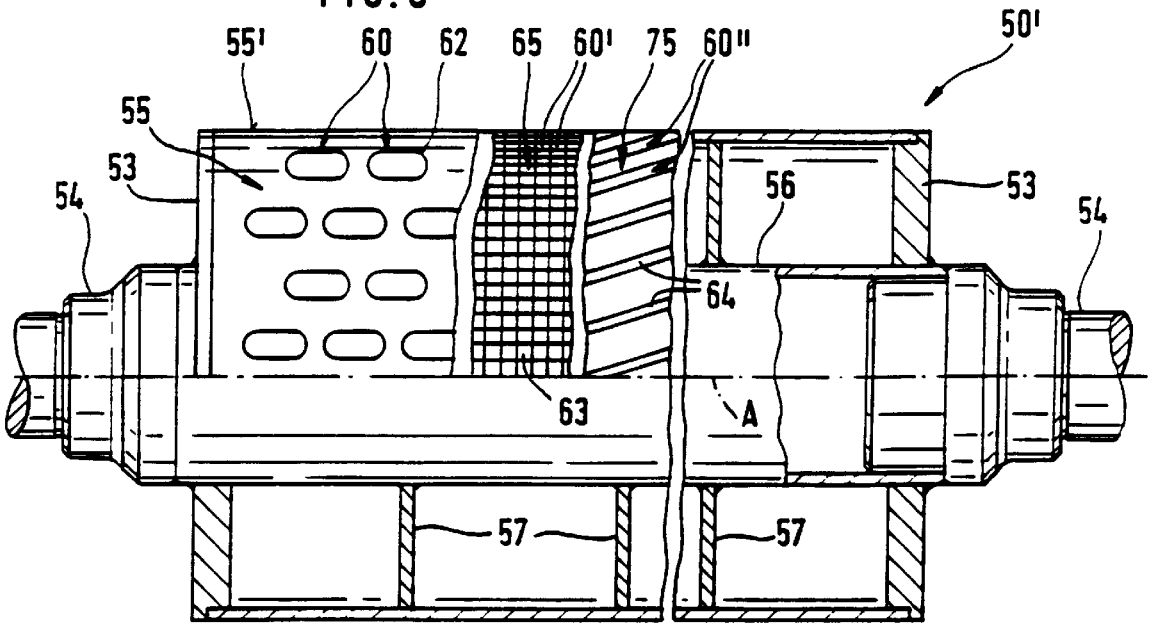

In order to be able to process critical rolls with very long lengths of very thin materials of acetate, viscose, or the like, on the jigger, guide rollers 50 are structured in a special way, as is shown in FIGS. 2 and 3.

Guide roller 50 of FIG. 2 comprises an inside roller 51 made of a cylindrical, closed roller tube 52 with end disks 53 arranged perpendicular to the axis, which bear roller journals 54 for mounting guide roller 50 into end plates 32. In the exemplary embodiment of FIG. 2, a perforated sheet metal plate 55 is drawn onto closed cylindrical outside circumference 52', forming a cylindrical circumference surface 55'. Guide roller 50 has openings 60 on its circumference, which are formed by perforated sheet metal plate 55 in the exemplary embodiment. In the exemplary embodiment, openings 60 are structured as axis-parallel oblong perforations 62. Perforated sheet metal plate 55 has punched perforations 60 which go through it, and are uniformly distributed over outside circumference 55', in such a way that there are no zones which run in the circumference direction which are never reached by a perforation 60. In the exemplary embodiment shown, perforations 60 are arranged on mantle lines 61 which run parallel to axis A of guide roller 50, and, if mantle lines 61 are adjacent to one another, offset relative to one another in the axis direction, so that the axial expanses of perforations 60 overlap one another. In the exemplary embodiment shown, guide roller 50 has a diameter of about one-tenth of the maximum fabric roll diameter, in other words about 150 mm. Perforations 60 are 8 mm wide in the circumference direction and form oblong perforations with a length of about 18 mm. The clear distances between perforations 60 along a mantle line 61 are 6 mm. The distances between mantle lines 61 in the circumference direction are about 18 mm. In the case of guide roller 50, openings 60 represent depressions which have a bottom in the form of outside circumference 52' of roller tube 52. In the exemplary embodiment, the open total area of oblong perforations 62 is approximately 20% of the total circumference surface of guide roller 50.

In the case of guide roller 50' in FIG. 3, instead of roller tube 52, which gives guide roller 50 of FIG. 2 its stability, a roller tube 56 with a lesser diameter than the one corresponding to the outside diameter of guide roller 50 is provided, which bears roller journals 54 and the length of which corresponds to about the working width of guide roller 50. End disks 53 carry a roller mantle which is made only of a perforated sheet metal plate 55 in the left region of guide roller 50', as it is also present in guide roller 50 of FIG. 2. In order to produce the necessary stability, perforated sheet metal plate 55 which forms cylindrical outside circumference 55' can be supported by disks 57 on roller tube 56, provided at intervals along the roller.

In the center region of guide roller 50', it is indicated that circumference 55' of guide roller 50' is formed by a lattice material, the lattice openings of which form openings 63, which are the deciding factor here. Here, cylindrical circumference surface 55' is produced by the cylindrical sheath surface of lattice material 65'. In lattice material 65, lattice openings 63 are not offset from one another. However, in this case the lattice openings are located so close to one another that there is no fear of irregularities in the distribution of the treatment liquid.

To the right of this, in FIG. 3, it is indicated that cylindrical circumference surface 55' is formed by a grooved sheet-metal plate 75, which is closed in itself, but has grooves 64 forming a screw-like pattern, which do not go through the entire thickness of the material, to form the roller tube of guide roller 50'. Here grooves 64 form openings 60".

It has been shown that perfect fabric rolls are obtained if guide roller 50 at winding roller 10 which is winding up the fabric has a surface structure as described in connection with FIGS. 2 and 3, and is pressed against fabric roll 10' from below, with a force to be adjusted to each individual case, but only serving to form fabric roll 10'. Openings 60, 60', 60" are escape spaces into which the treatment liquid entrained by textile web 11 can enter as the fabric passes around guide roller 50, particularly in the region of the nip formed between the latter and fabric roll 10', and from which it is given back to textile web 11 after it has left the nip. In this manner, a loss of the treatment liquid entrained from basin 13 by textile web 11 is counteracted, and it is wound into fabric roll 10' in the desired, sufficient amount. Nevertheless, guide roller 50, 50' rests against fabric roll 10' with its essentially still cylindrical circumference surface, benefitting the cylindricity and strength of the roll.

What is claimed is:

1. An apparatus for the liquid treatment of a textile web, comprising:

at least one driven winding roller, onto which a textile web can be wound, the at least one winding roller having a longitudinal axis;

one basin located below each driven winding roller and extending over the length of the winding roller, the basin being fillable with treatment liquid;

at least one deflection roller for a textile web located in the basin;

at least one guide roller which extends parallel to the axis of the winding roller over the width of the textile web, and which rests against the underside of a fabric roll which forms on the winding roller, the guide roller having a circumferential peripheral surface that is cylindrically smooth except for the presence of isolated openings which are located over the circumferential peripheral cylindrical surface of the guide roller, the openings being uniformly distributed so as to avoid circumferential zones lacking such openings;

wherein the textile web can be guided into the basin from below around the deflection roller, up to the guide roller, and through the nip between the guide roller and the fabric roll, onto the fabric roll.

2. An apparatus as set forth in claim 1, wherein the openings are in the form of depressions located along the circumferential periphery of the guide roller.

3. An apparatus as set forth in claim 2, wherein the openings are perforations.

4. An apparatus as set forth in claim 2, wherein the open total area of the openings amounts to 10 to 50% of the circumferential surface of the guide roller.

5. An apparatus as set forth in claim 1, wherein the openings are in the form of perforations in a guide roller mantle, which passes into the interior of the guide roller.

6. An apparatus as set forth in claim 1, wherein the openings are perforations.

7. An apparatus as set forth in claim 6, wherein the perforations are arranged on axis-parallel mantle lines, and in the case of adjacent mantle lines, are offset axially, relative to one another, in such a way that an overlap occurs in the circumferential direction.

8. An apparatus as set forth in claim 6, wherein the perforations are structured as axis-parallel oblong perforations.

9. An apparatus as set forth in claim 1, wherein the guide roller comprises a roller tube which is made of perforated sheet metal, lattice material, or grooved sheet metal.

10. An apparatus as set forth in claim 1, wherein the guide roller comprises a closed, cylindrical inner roller, on which a perforated sheet metal or lattice material which covers its entire circumference and rests directly on it is attached.

11. An apparatus as set forth in claim 1, wherein the openings are structured as grooves or channels which extend over at least a significant part of the circumferential surface of the guide roller.

12. An apparatus as set forth in claim 11, wherein the open total area of the openings amounts to 10 to 50% of the circumferential surface of the guide roller.

13. An apparatus as set forth in claim 1, wherein the open total area of the openings amounts to 10 to 50% of the circumferential surface of the guide roller.

14. An apparatus as set forth in claim 1, wherein the perforations are oblong and oriented with the axis of the guide roller.

* * * * *